US007789476B2

(12) United States Patent
Tomida et al.

(10) Patent No.: US 7,789,476 B2
(45) Date of Patent: Sep. 7, 2010

(54) PRINTING POSITION ALIGNMENT METHOD AND PRINTING APPARATUS

(75) Inventors: Akihiro Tomida, Kawasaki (JP); Akihiro Kakinuma, Hadano (JP); Daigoro Kanematsu, Yokohama (JP); Naoko Baba, Kawasaki (JP); Mitsutoshi Nagamura, Tokyo (JP); Asako Watanabe, Kawasaki (JP); Reiji Hashimoto, Yokohama (JP); Yoshinori Nakajima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 172 days.

(21) Appl. No.: 12/186,206

(22) Filed: Aug. 5, 2008

(65) Prior Publication Data

US 2009/0040263 A1 Feb. 12, 2009

(30) Foreign Application Priority Data

Aug. 7, 2007 (JP) ..... 2007-205911

(51) Int. Cl.
*B41J 29/393* (2006.01)

(52) U.S. Cl. ..... 347/19

(58) Field of Classification Search ..... 347/19; 358/504

See application file for complete search history.

(56) References Cited

U.S. PATENT DOCUMENTS 6,092,939 A 7/2000 Nishikori et al.
6,354,689 B1 * 3/2002 Couwenhoven et al. ..... 347/19
6,390,583 B1 5/2002 Kato et al.
6,450,606 B1 9/2002 Kato et al.
6,474,768 B1 11/2002 Yano et al.
6,494,557 B1 12/2002 Kato et al.
6,505,909 B1 1/2003 Kato et al.
6,739,699 B1 * 5/2004 Sender et al. ..... 347/43
7,377,613 B2 * 5/2008 Yamazaki et al. ..... 347/19
2009/0021543 A1 1/2009 Baba
2009/0040256 A1 2/2009 Baba et al.

FOREIGN PATENT DOCUMENTS

JP 10-329381 12/1998
JP 2006-102997 4/2006

* cited by examiner

*Primary Examiner*—Lamson D Nguyen
(74) *Attorney, Agent, or Firm*—Fitzpatrick, Cella, Harper & Scinto

(57) ABSTRACT

Multiple alignment patterns, each composed of first and second alignment pattern elements printed by forward and backward movements of a print head, respectively, are formed while the relative printing positions of the two elements are shifted. From optical characteristics data thereof, whether the data is influenced by a disturbance is determined. When the data is determined to be less influenced by the disturbance and therefore to be reliable, an adjusting value for aligning positions in printing in reciprocal movements is calculated by use of: data with the smallest relative printing position misalignment between the first and second alignment pattern elements; and data of optical characteristics close to the data. When the data is largely influence by the disturbance, a range of shifting of relative position is widened than that of the data less influenced by the disturbance so that more data pieces are used to obtain the adjusting value.

10 Claims, 9 Drawing Sheets

PRINTING POSITION ALIGNMENT METHOD AND PRINTING APPARATUS

BACKGROUND OF THE INVENTION

1. Field of the Invention

The present invention relates to a printing position alignment method in dot matrix printing, and a printing apparatus using the method.

2. Description of the Related Art

One type of printing apparatuses performing printing by forming dots on a printing medium uses a print head that moves in a predetermined direction relative to a printing medium and has, as printing elements, ink ejection openings arranged in a direction (e.g., in a direction in which a printing medium is conveyed) different from the predetermined direction. Nowadays, as for such a printing apparatus (an inkjet printing apparatus), there is a trend of increasing the number of ejection openings arranged in a print head to achieve a higher printing speed. Furthermore, increasingly widely used is a print head provided with multiple arrays of ejection openings corresponding to multiple ink colors so as to perform color printing. Particularly, the number of ink colors is increased in order to improve print quality, and not only cyan, magenta, yellow and black to reproduce a full color image but also inks in other color tone (color and density) are also increasingly used. For example, in some cases, light color inks are used to reduce a granular impression stemming from ink dots formed on a printing medium, or particular color inks such as red, blue and green are used to increase a color reproduction range.

Under the above circumstances, with the increase of the number of arrays of ejection openings formed in a print head, a misalignment of dot printing positions among arrays of ejection openings is more likely to occur due to a variation among ejection opening formation positions occurring at the time of manufacturing of a print head; a displacement of an attachment position of a print head; or the like. Further, also in a case of use of multiple print heads, a misalignment of dot printing positions may occur due to a relative position displacement among the print heads. In addition, even the same ejection openings may cause a misalignment between dot printing positions when performing printing (bi-directional printing) by reciprocal movement of the print head in both directions. When the misalignments of these dot printing positions occur as described above, print quality is deteriorated. One of heretofore-known technique for solving this problem is to perform a process of adjusting the dot printing positions by correcting the forgoing misalignments of dot printing positions (hereinafter, referred to as a registration process).

The registration process can be carries out in such a way that a certain array of ejection openings is determined as a reference array; the relative position misalignment between dots printed by the reference ejection opening array and dots printed by the other ejection opening array is obtained; and timing of ejecting inks is corrected based on the relative position misalignment. It is also possible to perform the registration process on misalignments of dot printing positions between a forward movement and a backward movement in bi-directional printing, by correcting the ejection timing in the same fashion.

The following method is cited as a method for obtaining an adjusting value to align dot printing positions. The method uses an array of ejection openings as a reference array and another array of ejection openings as an adjustment target array, and involves: printing multiple sample patterns (hereinafter, referred to as alignment patterns), while changing the ejection timing of the adjustment target array of ejection openings for each sample pattern; and then obtaining the adjusting value through a user's visual check on the sample patterns. Similarly, in a case of obtaining an adjusting value for dot print alignment in bi-directional printing, this method also involves: printing multiple alignment patterns while making the ejection timing in a backward movement differ from the ejection timing in a forward movement for each sample pattern; and providing the multiple alignment patterns to a user's visual check. In other words, the user selects a pattern in which a dot printing position is best matched, from among the multiple alignment patterns printed on a printing medium, and inputs its information to set an adjusting value for the printing apparatus.

However, this method forces a user to perform a complex operation of a visual judgment or a selection setting. In addition, improving an alignment accuracy requires an increase of the number of alignment patterns, so that the user needs to correctly judge small differences in misalignments of ink landed positions.

Therefore, in some cases, an alignment method is employed (e.g., Japanese Patent Application Laid-Open No. 10-329381 (1998)) in which a sensor is mounted on a carriage of an inkjet printing apparatus, and is caused to scan a printing medium so as to optically read alignment patterns, whereby the inkjet printing apparatus automatically determines an adjusting value.

Recently, the droplet size of ejecting ink has become smaller for improvement of image quality. Accordingly, an influence of an external disturbance on ink ejection or dot printing has become larger. The external disturbance includes, for example, a vibration occurring when a carriage with a print head mounted thereon moves, a change of the attitude of a print head in scanning due to distortion of a rail stay supporting the carriage, or waves (cockling) of a printing medium occurring when a pattern is printed on the printing medium. These external disturbances each not only act as a factor of a change in dot printing positions in printing of an alignment pattern, but also give an impact, if an automatic alignment is employed, on optical characteristics obtained by reading the alignment patterns with an optical sensor mounted on a carriage. In particular, in the case of an ink whose optical characteristic of alignment patterns is originally difficult to detect, like the light color ink described above, the optical sensor can only output data with a low S/N ratio, so that such ink is particularly susceptible to an influence of the external disturbance.

Possible countermeasures to check these external disturbances are to improve a mechanical accuracy of a printing apparatus, and to limit types of printing media for printing an alignment pattern thereon for an automatic alignment, to a type of printing medium enabling easy optical detection. However, these countermeasures are not desirable in terms of cost and usability. Therefore, it is strongly desired to determine an adjusting value with a certain degree of accuracy, even when an optically-read output value of an alignment pattern is influenced by an external disturbance.

As a prior art to meet such a demand, one disclosed in Japanese Patent Application Laid-Open No. 2006-102997 is cited. This document employs a method including: printing a pattern for abnormal detection in synchronization with alignment patterns; and correcting an output value obtained by reading an alignment pattern influenced by an external disturbance in alignment processing, or calculating an adjusting value by excluding an influenced pattern in calculating the adjusting value.

However, according to Japanese Patent Application Laid-Open No. 2006-102997, it is necessary to print the pattern for abnormal detection in addition to alignment patterns. Therefore, there are problems left that the performing of a registration process needs a long time; the printing of the pattern for abnormal detection accordingly increases an amount of ink to be consumed, and in some cases, increases an amount of printing media, i.e., requires more resources to be consumed.

SUMMARY OF THE INVENTION

An object of the invention is to enable an effective and automatic registration process which uses only a small amount of resources such as ink and printing media, while reducing an impact of an external disturbance.

In a first aspect of the present invention, there is provided a printing position alignment method for aligning printing positions by first and second printing operations, comprising: a printing step of printing a plurality of alignment patterns, each alignment pattern being composed of a first alignment pattern element printed by the first printing operation and of a second alignment pattern element printed by the second printing operation, the each alignment pattern indicating a different optical characteristic due to a misalignment in a relative printing position of the second alignment pattern element relative to the first alignment pattern element, and the plurality of alignment patterns being printed by shifting the relative printing position of the second alignment pattern element relative to the first alignment pattern element; a measuring step of measuring the respective optical characteristics of the plurality of alignment patterns;

a determination step of determining reliability of the plurality of alignment patterns based on, among data of the plurality of optical characteristics thus measured, data indicating that a misalignment of the relative printing position of the second alignment pattern element to the first alignment pattern element is smallest and data of optical characteristics in the neighborhood of the data indicating the smallest misalignment; and an adjusting value obtaining step of, in a case where the reliability is determined to be high in the determination step, obtaining an adjusting value for aligning the printing positions based on a smaller number of pieces of data of the optical characteristics than that in the case where the reliability is determined to be low.

In a second aspect of the present invention, there is provided a printing position alignment method for aligning printing positions by first and second printing operations, comprising: a printing step of printing a plurality of first alignment patterns, each first alignment pattern being composed of a first alignment pattern element printed by the first printing operation and of a second alignment pattern element printed by the second printing operation, the each first alignment pattern indicating a different optical characteristic due to a misalignment in a relative printing position of the second alignment pattern element relative to the first alignment pattern element, and the plurality of first alignment patterns being printed by shifting the relative printing position of the second alignment pattern element relative to the first alignment pattern element; a measuring step of measuring the respective optical characteristics of the plurality of alignment patterns; a determination step of determining reliability of the plurality of the first alignment patterns based on, among data of the plurality of optical characteristics thus measured, data indicating that a misalignment of the relative printing position of the second alignment pattern element to the first alignment pattern element is smallest and data of optical characteristics in the neighborhood of the data indicating the smallest misalignment; and an adjusting value obtaining step of, in a case where the reliability is determined to be low in the determination step, obtaining an adjusting value for aligning the printing positions based on data of the plurality of optical characteristics, and in a case where the reliability is determined to be high in the determination step, printing a plurality of second alignment patterns different from the first alignment patterns, measuring respective optical characteristics of the second alignment patterns thus printed, and obtaining an adjusting value for aligning the printing position on the basis of data of the plurality of optical characteristics of the second alignment patterns thus measured.

In a third aspect of the present invention, there is provided a printing apparatus that performs first and second printing operations and capable of aligning printing positions by the first and second printing operations, comprising: a controller which makes print a plurality of alignment patterns, each alignment pattern being composed of a first alignment pattern element printed by the first printing operation and of a second alignment pattern element printed by the second printing operation, the each alignment pattern indicating a different optical characteristic due to a misalignment in a relative printing position of the second alignment pattern element relative to the first alignment pattern element, and the plurality of alignment patterns being printed by shifting the relative printing position of the second alignment pattern element relative to the first alignment pattern element; a measuring unit which measures the respective optical characteristics of the plurality of alignment patterns; a determination unit which determines reliability of the plurality of alignment patterns based on, among data of the plurality of optical characteristics thus measured, data indicating that a misalignment of the relative printing position of the second alignment pattern element to the first alignment pattern element is smallest and data of optical characteristics in the neighborhood of the data indicating the smallest misalignment; and an adjusting value obtaining unit, in a case where the reliability is determined to be high by the determination unit, which obtains an adjusting value for aligning the printing positions based on a smaller number of pieces of data of the optical characteristics than that in the case where the reliability is determined to be low.

In a fourth aspect of the present invention, there is provided a printing apparatus that performs first and second printing operations and capable of aligning printing positions by the first and second printing operations, comprising: a controller which makes print a plurality of first alignment patterns, each first alignment pattern being composed of a first alignment pattern element printed by the first printing operation and of a second alignment pattern element printed by the second printing operation, the each first alignment pattern indicating a different optical characteristic due to a misalignment in a relative printing position of the second alignment pattern element relative to the first alignment pattern element, and the plurality of first alignment patterns being printed by shifting the relative printing position of the second alignment pattern element relative to the first alignment pattern element; a measuring unit which measures the respective optical characteristics of the plurality of alignment patterns; a determination unit which determines reliability of the plurality of the first alignment patterns based on, among data of the plurality of optical characteristics thus measured, data indicating that a misalignment of the relative printing position of the second alignment pattern element to the first alignment pattern element is smallest and data of optical characteristics in the neighborhood of the data indicating the smallest misalignment; and an adjusting value obtaining unit which, in a case where the reliability is determined to be low by the determination unit, obtains an adjusting value for aligning the printing positions based on data of the plurality of optical characteristics, and in a case where the reliability is determined to be high by the determination unit, prints a plurality of second alignment patterns different from the first alignment patterns, measures respective optical characteristics of the second alignment patterns thus printed, and obtains an adjusting value for aligning the printing position on the basis of data of the plurality of optical characteristics of the second alignment patterns thus measured.

In the invention, it is determined whether from data of optical characteristics of respective alignment patterns, the data are influenced by a disturbance. When the influence of the disturbance is small so that the data are reliable, a piece of data in which a misalignment of a relative printing position of the second alignment pattern elements to the first alignment pattern elements is smallest and data of optical characteristics in the neighborhood of the piece of data are used so that an adjusting value is calculated. In such a range, a change of density to relative shifting amount of printing position is obtained as a simple function so that an adjusting value can be determined with high accuracy. Meanwhile, when the influence of the disturbance is large, a range of an amount of shifting of a relative position is made wider than that in the case where the influence of the disturbance is small, a large number of pieces of data of optical characteristics are used. Thus, since a change of optical characteristics (density) becomes large, a ratio of the disturbance to a density curve is reduced, and an increase of the number of pieces of data to be used is capable of improving the reliability of an adjusting value.

As described above, in accordance with the invention, when performing an automatic registration process, it becomes possible to improve the efficiency of the process and reduce an amount of resource such as ink and printing media as much as possible, with the influence of a disturbance being reduced.

Further features of the present invention will become apparent from the following description of exemplary embodiments (with reference to the attached drawings).

DESCRIPTION OF THE EMBODIMENTS

The invention is described in detail below with reference to the drawings.

(Basic Configuration Example of Inkjet Recording Apparatus)

FIGS. 1 to 4 are views showing a basic configuration example of an inkjet printing apparatus to which the invention is applicable.

Figure 1:
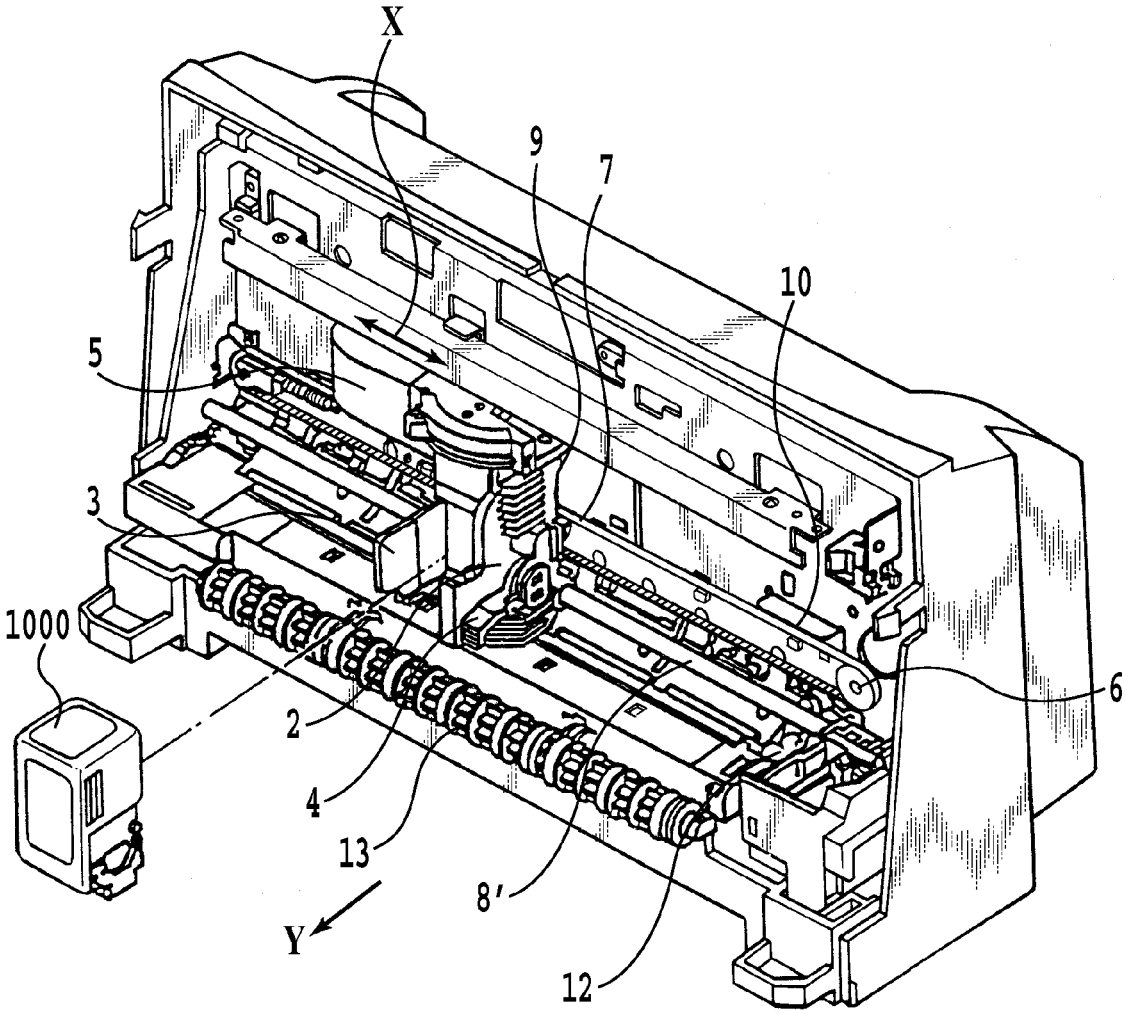
FIG. 1 is a perspective view showing a basic configuration example of an inkjet printing apparatus to which the invention is applicable.

FIG. 1 is a perspective view showing a configuration example of a color inkjet printing apparatus to which the invention is applicable, and shows a state in which a front cover is removed to expose the inside of the apparatus.

In FIG. 1, reference numeral 1000 denotes a replaceable inkjet cartridge, and reference numeral 2 denotes a carriage unit for detachably holding the inkjet cartridge 1000. Reference numeral 3 denotes a holder fastening the inkjet cartridge 1000 to the carriage unit 2. When a cartridge fastening lever 4 is operated after the inkjet cartridge 1000 is mounted into the carriage unit 2, the inkjet cartridge 1000 is brought into contact with the carriage unit 2 by pressuring. Due to this contact, the inkjet cartridge 1000 is positioned and, at the same time, an electric contact for signal transmission provided to the carriage unit 2 is connected with an electric contact on the side of the inkjet cartridge 1000. Reference numeral 5 denotes a flexible cable through which an electric signal is transmitted to the carriage unit 2.

Further, while not shown in FIG. 1, in an automatic registration process system, the carriage unit 2 is provided thereon with a reflection type optical sensor (described later) which serves as a function to detect printing densities of a plurality of alignment patterns printed on a printing medium. A conveyance of a printing medium in an arrow Y direction and a movement of the carriage unit 2 to which the optical sensor is attached in an arrow X direction, are alternately performed, whereby densities of a group of alignment patterns printed on the printing medium can be detected. This optical sensor may also be used as a detection unit for detecting an edge of the printing medium.

Reference numeral 6 denotes a carriage motor which reciprocates the carriage unit 2 in the X direction as a drive source, and reference numeral 7 denotes a carriage belt which transmits power of the carriage motor 6 to the carriage unit 2. Reference numeral 8' denotes a guide shaft, extending in the X direction, which supports and guides the carriage unit 2 to allow the carriage unit 2 to move in the X direction. Reference numeral 9 denotes a transmission type photo coupler attached to the carriage unit 2, and reference numeral 10 denotes a light shielding plate disposed in a vicinity of a predetermined carriage home position. Reference numeral 12 denotes a home position unit including a recovering system such as a capping member which caps a face (ejection face) of an inkjet print head on which ejection openings are formed, a suction unit which sucks this capping member, a member wiping the ejection face of the print head, and the like.

Reference numeral 13 denotes a discharge roller for discharging a printing medium. The discharge roller holds a printing medium between itself and an unillustrated spur-like roller in cooperation to discharge the printing medium to the outside of the printing apparatus. Reference numeral 14 denotes a line feed unit which conveys a printing medium in the Y direction by a predetermined amount.

Figure 2A:
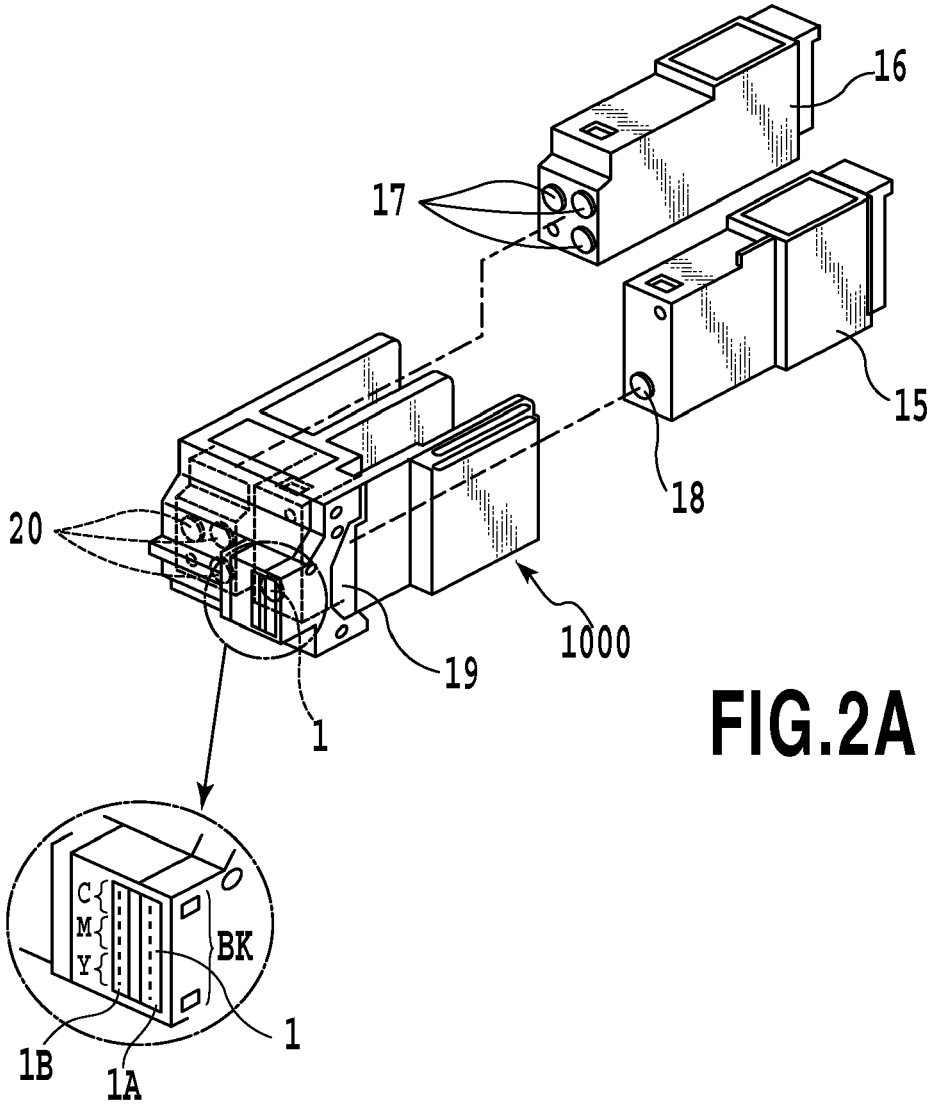
FIG. 2A is an exploded-perspective view of an inkjet cartridge of the inkjet printing apparatus of FIG. 1.

FIG. 2A is a perspective view showing details of the inkjet cartridge 1000.

Reference numeral 15 denotes an ink tank storing a black (Bk) ink, and reference numeral 16 denotes an ink tank storing inks of cyan (C), magenta (M), and yellow (Y). These ink tanks are detachable to an inkjet cartridge main body. Reference numeral 17 denotes connection openings on the ink tank 16 side, which openings correspond to ink supply tubes 20 on the inkjet cartridge main body side to introduce the respective inks stored in the ink tank 16 thereto. Reference numeral 18 denotes connection openings on the ink tank 15 side, which correspond to ink supply tubes on the inkjet cartridge main body side to introduce the black ink stored in the ink tank 15 thereto. The connection openings 17, 18 are connected with the corresponding ink supply tubes on the inkjet cartridge main body side, and the connection enables a supply of ink to the print head 1 held in the inkjet cartridge main body. Reference numeral 19 denotes an electric contact portion, and connection with the electric contact portion disposed on the carriage unit 2 enables a receipt of an electric signal from a controller of the main body of the printing apparatus via the flexible cable 5.

In this example, used is the print head 1 including a black ink ejection opening array 1A with ejection openings disposed to eject black ink, and a color ink ejection opening array 1B. These arrays are disposed in parallel with each other. In the color ink ejection opening array 1B, a group of ejection openings for ejecting Y, M, and C is integrally formed in an in-line fashion, and is disposed in parallel with the black ink ejection opening array 1A.

Figure 2B:
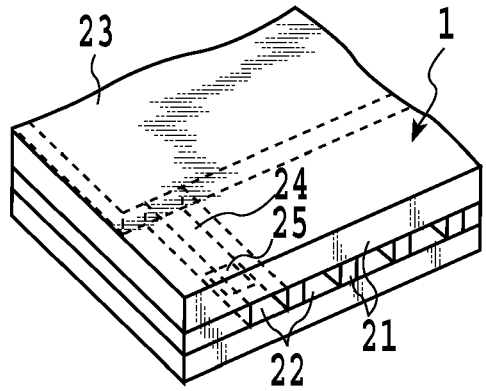
FIG. 2B is an enlarged perspective view of an ejection opening array of the inkjet cartridge.

FIG. 2B is a schematic perspective view showing a fragment of a main-portion structure of the print head 1 of the inkjet cartridge 1000.

In each ejection opening array of the print head 1, a plurality of ejection openings 22 are formed at predetermined pitches on the ejection face 21 facing a printing medium with a gap (e.g., approximately 0.5 mm to 2.0 mm) interposed therebetween. An electrothermal transducer element (a heating resistor or the like) 25 is provided along a wall surface of each liquid passage 24 communicating the ejection opening 22 and a common liquid chamber 23, and generates thermal energy for ink ejection. The inkjet cartridge 1000 of this example is mounted on the carriage unit 2 so that the ejection openings 22 of each ejection opening array are aligned in a direction crossing the moving direction of the carriage unit 2 (for example, in the direction of conveying a printing medium). Further, the electrothermal transducer elements 25 corresponding to an image signal or an ejection signal are driven to boil an ink in the liquid passage 24 into film-boiling. At this time, pressure induced by bubbles thus generated causes the ink to be ejected through the ejection openings 22.

Figure 3:
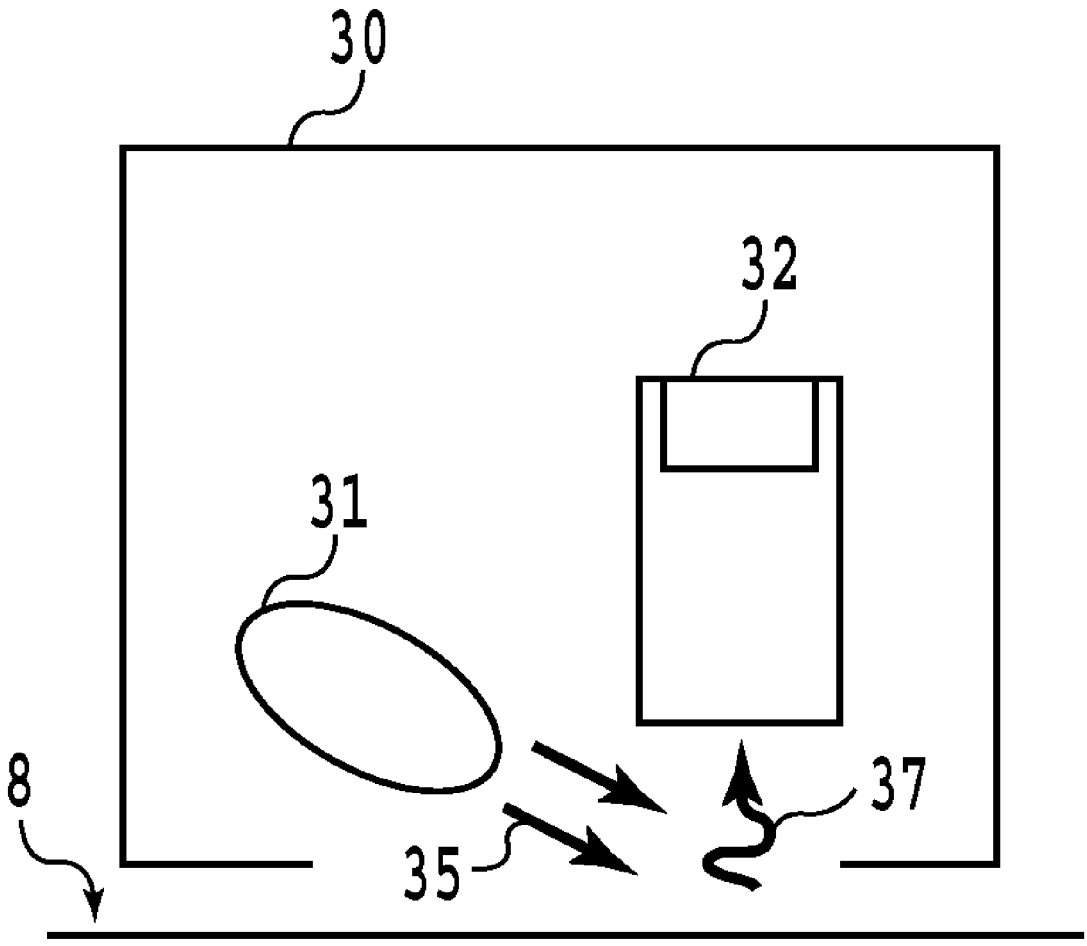
FIG. 3 is a schematic view of an optical sensor mounted on the inkjet printing apparatus of FIG. 1.

FIG. 3 is a schematic view for explaining a reflection type optical sensor mounted on the carriage unit 2.

A reflection type optical sensor 30 includes a light emitter 31 and an optical receiver 32. Light beam 35 emitted from the emitter 31 is reflected on a printing medium 8, and a reflected light beam 37 is detected by the optical receiver 32. A detection signal of the optical receiver 32 is transmitted to an electric board of the printing apparatus as information. In order to detect densities of a group of alignment patterns printed on the printing medium 8 in such a manner that the detected densities are equal to those viewed by a person, a configuration for detecting a diffusion light is made by use of different light angles between incidence and reflection.

In this example, considering that inks of the respective colors, C, M, Y, and black are used in a registration process, a white LED or a three primary color LED is used for the light emitter 31, and a photodiode having sensitivity for visible light is used for the optical receiver 32. When ink dots of two different colors are targets for alignment, it is preferable that a three primary color LED be used for the light emitter 31 since the three primary color LED is capable of selecting and emitting a color with high sensitivity for alignment patterns printed with the two different colors.

Figure 4:
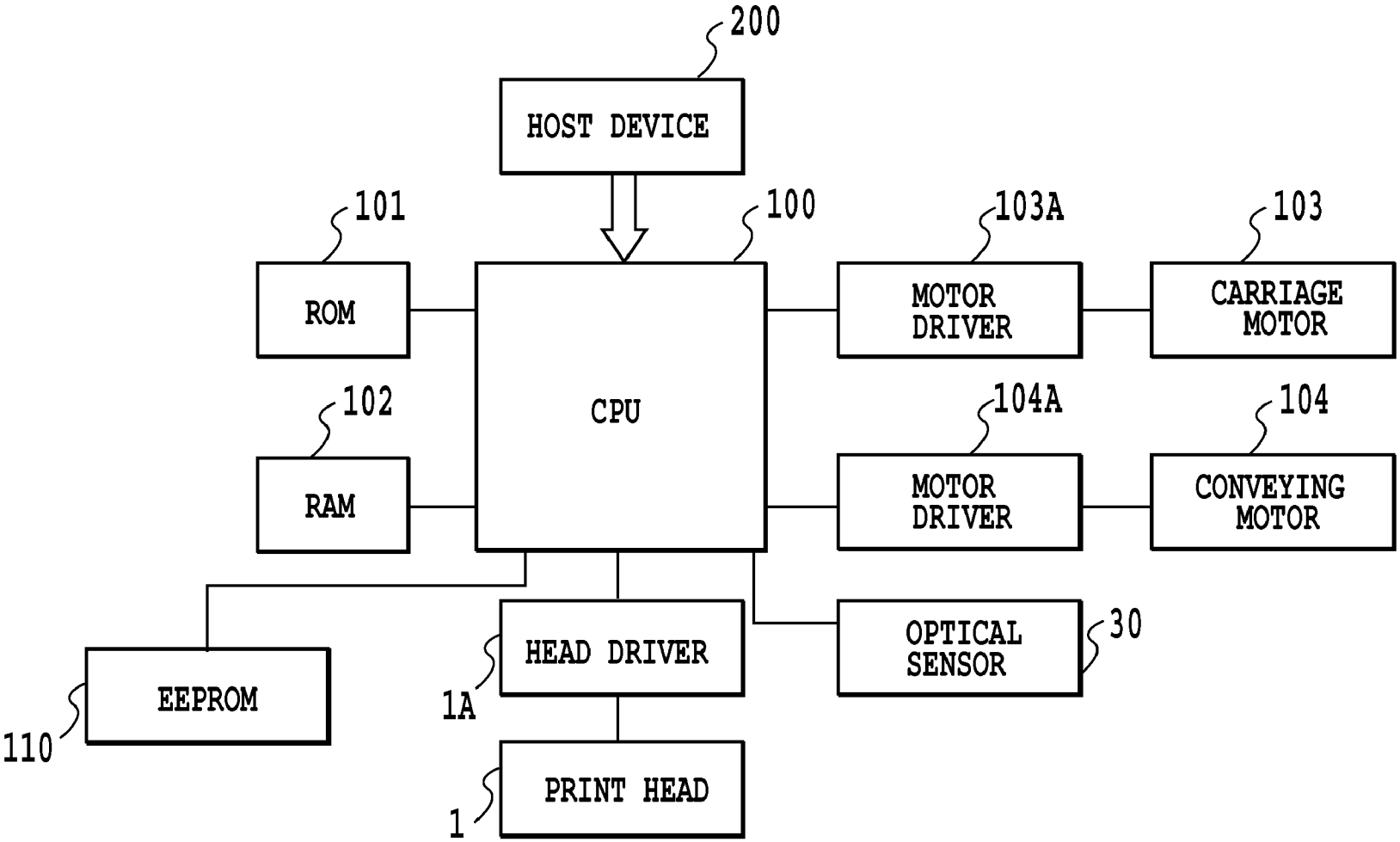
FIG. 4 is a block diagram showing a configuration example of a control system of the inkjet printing apparatus of FIG. 1.

FIG. 4 is a block diagram showing a diagrammatic configuration example of a control system of the printing apparatus.

In FIG. 4, a CPU 100 performs a control process of operation of the printing apparatus, a data process, and the like including processes to be described later with reference to FIG. 7 or FIG. 9. A ROM 101 stores therein programs such as procedures for the above, and a RAM 102 is used as a work area or the like for performing these processes. Reference numeral 110 denotes a nonvolatile memory such as an EEPROM, which stores therein required information even when the apparatus is turned off.

The ejection of ink from the print head 1 is performed by supplying drive data (image data) and drive control signal (a heat pulse signal) to a head driver 1A, which supply is performed by the CPU 100. The CPU 100 controls a carriage motor 103 for driving the carriage in the X direction of FIG. 1 via a motor driver 103A, and also controls a conveying motor 104 for conveying a printing medium in the Y direction of FIG. 1 via a motor driver 104A.

In addition, as will be described later, the CPU 100 performs an alignment process (registration process) for a printing position by utilizing an optical sensor 30. A function of this alignment process may be performed on a host device 200 side which supplies image data to the printing apparatus. An obtained adjusting value may also be stored in the host device 200.

[Recording Alignment Pattern]

In the registration process of this embodiment, a plurality of alignment patterns are first printed on a printing medium. At this time, alignment patterns are each composed of a first alignment pattern element printed by a first printing operation and a second alignment pattern element printed by a second printing operation, but printing positions of the second alignment pattern elements relative to the first alignment pattern elements are different from each other. Determination of arrays of ejection openings used for forming the first and second alignment pattern elements on the first and second printing operations depends on the combination of ink colors of an alignment target and moving directions.

An example of this combination will be described. In this example, there are provided ejection opening array 1A for black ink and ejection opening array 1B for color inks. In alignment in the case where the carriage moves in a forward direction, a reference array (for example, the ejection opening array for black ink) is determined from among these arrays to print a group of first alignment pattern elements, while a group of second alignment pattern elements is printed by the other ejection opening array (for example, the ejection opening array for color inks). Alignment in the carriage movement in the backward direction is performed in the same manner. Further, when the number of ejection opening arrays is three or more, a plurality of groups of alignment patterns may be printed depending on the number of combinations of a reference ejection opening array and each of the other ejection opening arrays. In addition, concerning alignment patterns for the alignment of bi-directional printing, only the reference ejection opening array is used, and a group of first alignment pattern elements and a group of second alignment pattern elements are printed in a forward directional movement and a backward directional movement of the carriage, respectively.

In any case, relative printing positions of the second alignment pattern elements to the first alignment pattern element are different. The number of alignment patterns or of elements thereof can be determined depending on a unit of shifting of a relative printing position required for satisfying a requirement of an accuracy of the registration process and depending on an alignment range required based on a mechanical tolerance of an apparatus. A printing area of alignment patterns can be optimized with respect to the size of a printing medium to be used for alignment pattern printing and the throughout of alignments, on the basis of the size of a detection area of an optical sensor, a range of width in which printing is possible in one movement of the carriage, the size of the printable area of a printing medium for a group of alignment patterns, and the like.

Alignment patterns are printed so that a change of an optical characteristic, i.e., a change of density, occurs in proportion to a shifting amount of a relative printing position of the second alignment pattern element to the first alignment pattern element.

Figure 5A:
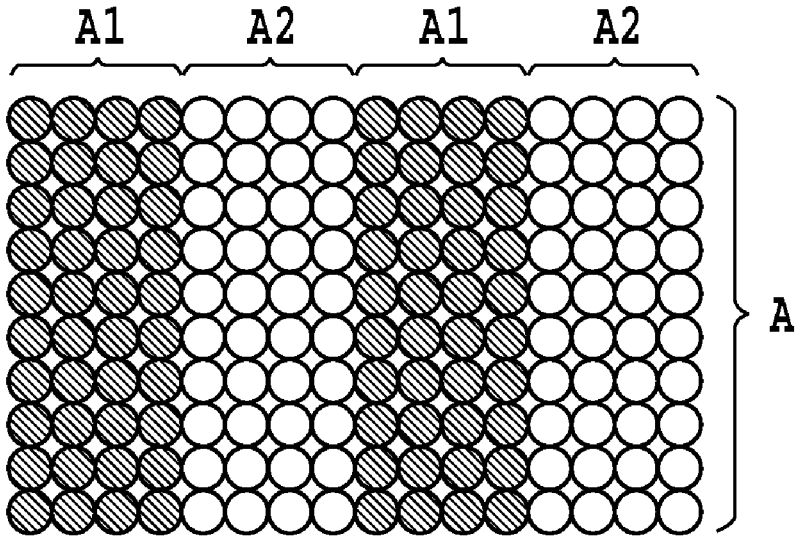
FIGS. 5A to 5C are each an example of alignment patterns applicable to a first embodiment of the invention, which example is composed of two complementary alignment pattern elements.
Figure 5B:
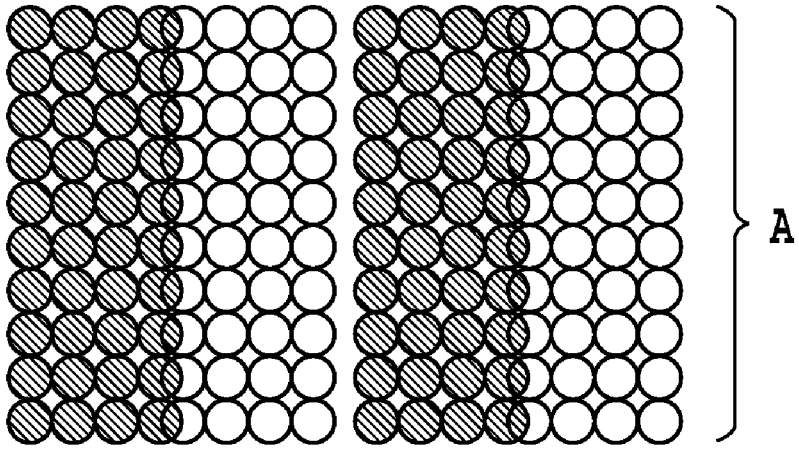
Figure 5C:
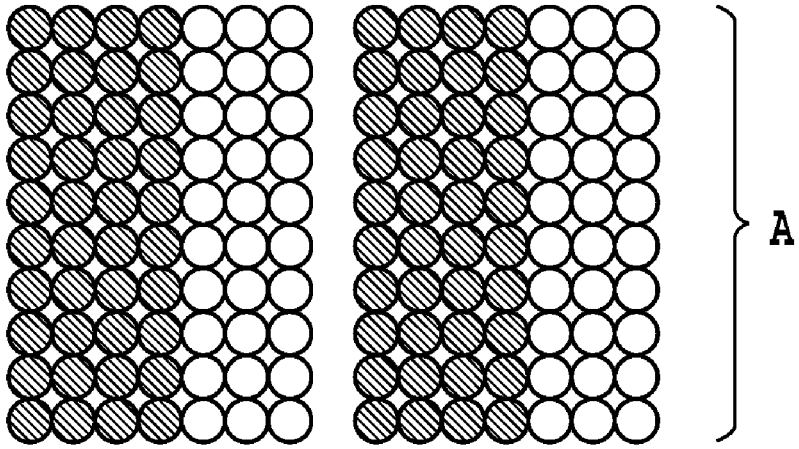

FIGS. 5A to 5C are each a schematic view of an alignment pattern A composed of first and second alignment pattern elements A1 and A2.

In FIGS. 5A to 5C, dots depicted by black circles represent ink dots of the first alignment pattern element A1. Dots depicted by white circles represent ink dots of the second alignment pattern element A2. In FIGS. 5A to 5C, although black and white dots are used for the sake of description only, this is not intended to represent colors and densities of inks.

FIG. 5A is an explanatory view of a state in which printing positions of the first and second alignment pattern elements A1 and A2 are aligned with each other. FIG. 5B shows a state in which printing positions of both elements are slightly misaligned from each other, and FIG. 5C shows a state in which printing positions of both elements are further misaligned from each other.

A group of alignment patterns A of this example is set so that densities of all alignment patterns are reduced as a misalignment of printing positions between the first and second alignment pattern elements A1 and A2 increases. That is, in FIG. 5A, an area factor covered with dots is approximately 100%. Further, as shown in FIGS. 5B and 5C, as a misalignment of the printing positions increase, an amount of overlap between the first A1 and second alignment pattern elements A2 also increases, so that an area on which printing is not performed, i.e., an area which is not covered with dots, develops.

That is, an object of the groups of alignment patterns is to cause the area factor to be reduced as the relative printing positions of the second alignment pattern elements A2 to the first alignment pattern elements A1 are misaligned to a larger extent. Printing density depends strongly on the area factor. Therefore, an increase of an area with no printing influences more on entire density than an increase of density due to overlaps of dots does. Accordingly, based on a change of density obtained by the reading of a group of alignment patterns by the optical sensor 30, and based on a condition of a relative printing position in the case where density is highest, an adjusting value can be obtained.

In addition, as the disposition of alignment patterns, as shown in the examples of FIGS. 5A to 5C, the first and second alignment pattern elements may be disposed on different regions, respectively, in the X direction (left and right directions in FIGS. 5A to 5C) of FIG. 1, or may be disposed on the same region.

Figure 6A:
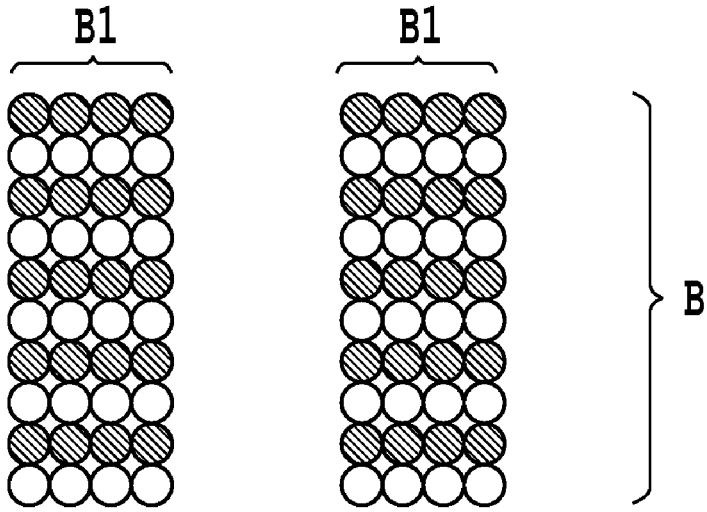
FIGS. 6A to 6C are each another example of alignment patterns applicable to the first embodiment of the invention, the example being composed of two alignment pattern elements disposed in the same position.
Figure 6B:
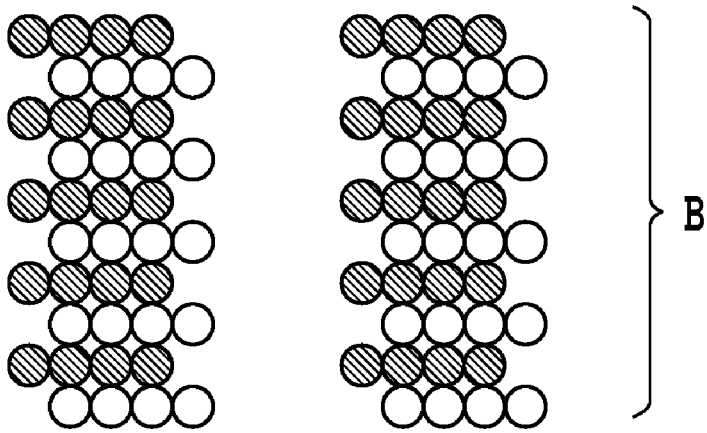
Figure 6C:
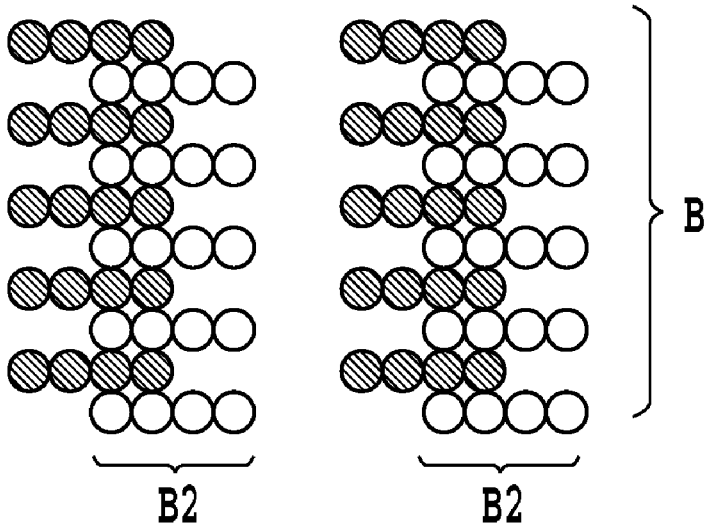

FIGS. 6A to 6C show an example of an alignment pattern B in which dots are disposed on the same positions in the X direction. In the example shown in the drawings, for the sake of convenience, dots composing a first alignment pattern element B1 and a second alignment pattern element B2 are depicted so that the dots do not overlap each other in a conveying direction (upward and downward directions in FIGS. 6A to 6C), but in practice, the dots may overlap each other in conveying direction, which causes no problem. In this example, in a state (FIG. 6A) printing positions are aligned, since an area in which dots are disposed is small and the area factor is small, density is reduced. In FIG. 6B in which printing positions are misaligned, the positions of dots of the first and second alignment pattern elements B1 and B2 are misaligned whereby the area factor is increased, so that density is increased. As in FIG. 6C, when the printing positions are further misaligned, density is further increased.

As shown in the above two examples, the point is that, on condition that an area factor or density sensitively changes depending on magnitudes of misalignments of the first and second alignment pattern elements, appropriate alignment patterns can be employed.

[Reading Alignment Pattern]

Groups of alignment patterns printed in the above manner are scanned by the optical sensor 30, which is mounted on the carriage unit 2 and includes a white LED or a three primary color LED of RGB and a photo diode, so that optical characteristic (density) is measured. For the LED to be used, a color having the highest detection efficiency is selected for each ink to be measured. A signal detected by the optical sensor 30 is transmitted to an unillustrated A/D converter, and thereby, a converted signal is stored in a RAM 102 as a density data value of a read alignment pattern.

The optical sensor 30 only needs to have a detection capability good enough to obtain a density difference among multiple alignment patterns each composed of two alignment pattern elements, and does not necessarily have a detection capability good enough to detect an absolute value of the densities. Further, the optical sensor 30 preferably has resolutions which can be used for detection in a narrower range than a range on which a single alignment pattern is printed.

[Calculation of Alignment Value]

An adjusting value for a registration process is calculated by use of pattern density read by the optical sensor 30 and a shifting amount xi (i denotes a number allocated to each alignment pattern) of a relative position of a second alignment pattern element to a first alignment pattern element set with respect to each alignment pattern.

Figure 8:
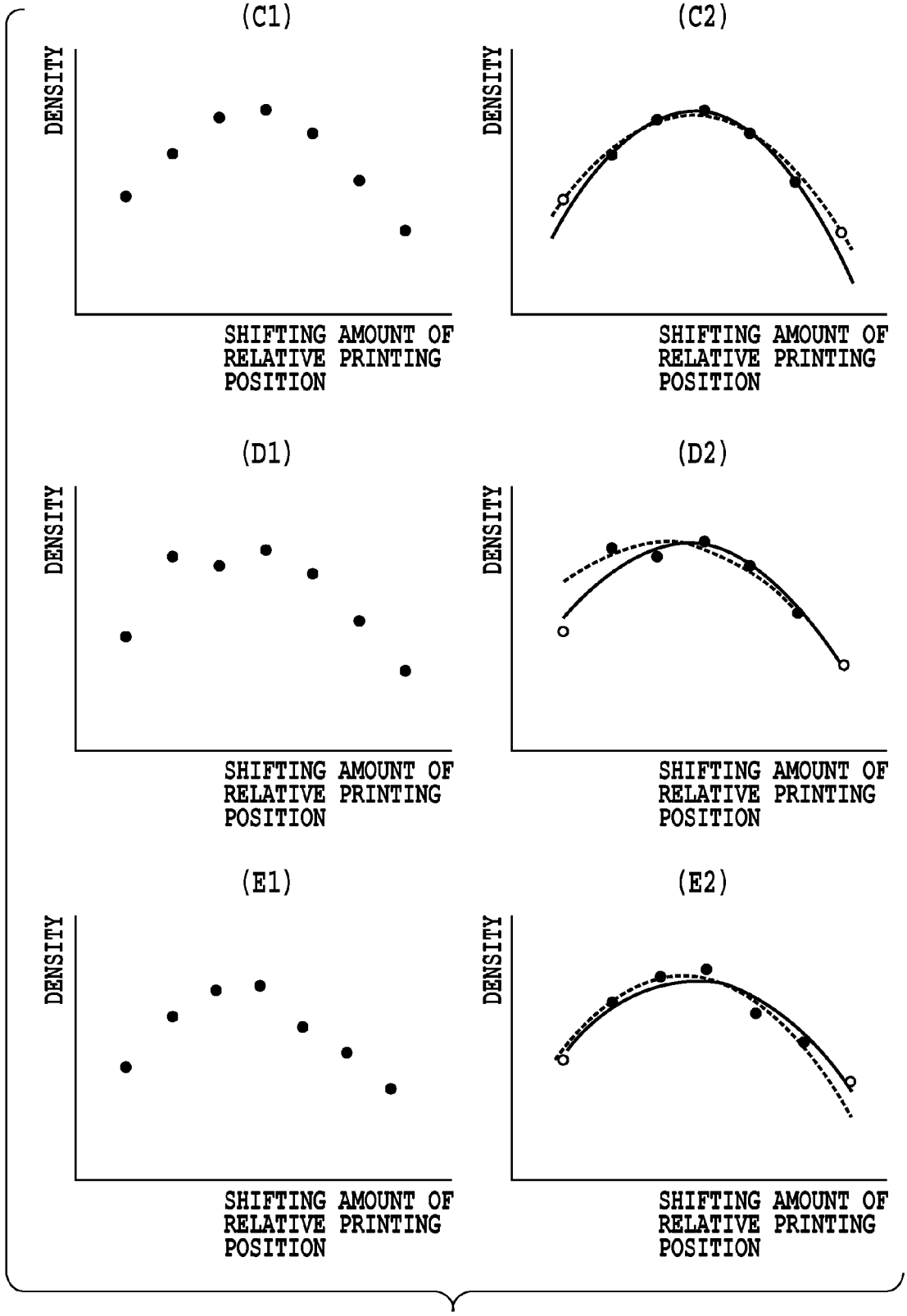
FIG. 8 shows some examples of density data and approximation curves in order to explain an application of the reliability determination methods of the first embodiment of the invention.

FIG. 8 show examples of distributions of density with respect to shifting amounts of relative positions. A position where printed dots of two alignment pattern elements correctly aligned each other is a position with the highest density in the case of complementary dot arrangement (FIG. 5), or is a position with the lowest density in the case of dot arrangement in the same position (FIG. 6). When a required alignment resolution is on the order of relative printing position shifting unit of the alignment pattern group, an adjusting value may be determined based on the position shifting amount xi of patterns aligned best in the alignment pattern group. When a resolution higher than the above is required, an approximate curve representing a continuous density distribution is firstly obtained based on the relationship between the relative position shifting amount xi of the alignment patterns and the density, and then an adjusting value for best aligned patterns is obtained.

In order to obtain a continuous density distribution for shifting amounts xi of a relative positions, an approximate curve is calculated from density data of each pattern. A function determined as an approximate curve is aimed at calculating a shifting amount xi of a relative position at which a density distribution attains its peak, so that it is only necessary that a density distribution can be reproduced for shifting amounts of relative positions within a certain range from the peak of the density distribution. Therefore, certain density data which are within a range of shifting amounts of relative positions reproducible by an approximate curve are extracted and thereby used. A parameter for determining an approximate curve is determined from the density data thus extracted, and an adjusting value is determined from a shifting amount of a relative position corresponding to a peak position of the curve.

The printing apparatus stores therein an adjusting value to control timing of one of two printing operations as targets of a registration process to align printing positions of the two printing operations. When updating is not necessary to the adjusting value, a default value of the adjusting value may be determined in a process of inspection at the time of factory shipping, and the ROM 101 storing the default value may be mounted on the printing apparatus. However, when a registration process is performed by a user's instruction or by a service person, or when it is hand-carried to a service center to be performed, the adjusting value is stored in an EEPROM 110 to enable an update as needed. In this case, an alignment pattern is printed with timing of one printing operation controlled or shifted based on an adjusting value stored in the printing apparatus to obtain information of the timing of a printing operation that achieves the smallest relative position misalignment among elements. When the smallest misalignment is obtained among printed alignment patterns, information of timing of a printing operation is obtained. Further, based on the timings of printing the alignment patterns, and the timing of the printing operation that achieves the smallest relative position misalignment, a new adjusting value is determined and stored in the EEPROM 110. In any case, the adjusting value is referred as a printing timing correction value at the time of printing of an image.

The magnitude of a change of density of an alignment pattern with respect to a shifting amount of a relative position is varied depending on an ink for printing an alignment pattern, a printing method, a printing medium, or the like, but a correlation of a density to an area factor is not supposed to be changed. However, when the shape of a density distribution measured by the optical sensor 30 in practice does not show a monotonic change to a change of an area factor, it can be said that density data have changed due to a disturbance. When an influence from a disturbance is large as described above, an alignment pattern exhibiting the foregoing maximum density, or a peak position of a density distribution curve does not match a position at which an actual amount of misalignment of a relative position becomes minimum. In order to exclude this influence, there is a method in which as in Japanese Patent Application Laid-Open No. 2006-102997, density data of an alignment pattern influenced by a disturbance are not used at the time of calculation of an adjusting value, and in which a pattern to correct a change of density caused by a disturbance is simultaneously printed.

[Embodiment of Calculation Method of Alignment Value]

In this embodiment, however, as a calculation method of an adjusting value, used is a method in which a change of density with respect to a shifting amount of a relative position is obtained from an alignment pattern as a density curve. For density data to be used for determining this density curve, used are only points in a range in which a curve and a density data distribution are consistent with each other to a large degree. This is more desirable to obtain the position of a peak of a density distribution with high accuracy. However, an excessive limitation on density data to be used causes the density data to be more influenced by a change of density data stemming from a disturbance. Thus, reliability of density data is determined by using a method to be described later for measuring an impact of a disturbance on density data, and when the reliability is high, a range of density data to be used for a calculation of an adjusting value is narrowed, and when the reliability is low, the range of density data is widened. In this manner, a change of density with respect to an area factor made relatively larger than a change caused by a disturbance checks a deterioration of an accuracy of determination of an adjusting value is checked.

More specifically, in this embodiment, reliability can be determined by using the following three methods.

[First Reliability Determination Method]

A change of density with respect to a shifting amount of a relative position of alignment patterns can be predicted from a change of density with respect to a change of an area factor. As an area factor increases, density increases, and as the area factor decreases, density decreases. In other words, for an alignment pattern in which printing positions of two alignment pattern elements of the alignment pattern are best aligned in a group of the alignment patterns, density becomes maximum in the case of FIG. 5 (minimum in FIG. 6). As a shifting amount of a relative position increases, density is expected to decrease in FIG. 5 (increase in FIG. 6).

The magnitude of a change of density with respect to a shifting amount of a relative position of alignment patterns varies depending on inks with which an alignment pattern is printed, a printing method, a printing medium, and the like, but a slope of a change of density with respect to a change of an area factor is expected to remain unchanged. In addition, each shifting amount of a relative printing position of a second alignment pattern element with respect to a first alignment pattern element is a predetermined value. However, the shape of a density distribution actually measured by the optical sensor 30 sometimes shows that there is no monotonic change to a shifting amount of a relative printing position. In this case, it is considered that a variation has occurred in density data since a printing position is different from a supposed position due to a disturbance, or since a correct reading of the density of the alignment pattern cannot be made using the optical sensor 30 at the time of a measurement of the density. As described above, when an influence of a disturbance is large, reliability of density data is judged to be low.

[Second Reliability Determination Method]

In a calculation of an adjusting value, a density curve is obtained in a range of data having a high reliability. As described above, the data are those extracted in a range in which extracted data are quite consistent with an approximate curve of a change of density with respect to a shifting amount of a relative position. When a correlation between the density data and the curve is deteriorated in this range, it may be considered that a variation due to a disturbance is large. A standard deviation as a parameter indicating the correlation between the density data and the curve, and a threshold value of the standard deviation are set, the standard deviation being obtained from the density data and the curve, and the threshold value being one in which an adjusting value does not greatly vary due to a disturbance. When the density data has a standard deviation not less than the threshold value, it is determined that an influence of a disturbance on a change of density is large in the range of the data so that the reliability of the density data is low.

The parameter indicating a correlation between the density data and the density curve to be used in the second reliability determination method may be one other than the standard deviation. For example, by use of even a coefficient of correlation, a variance, or the like, it is possible to determine whether there is a certain correlation between density data and a density curve.

[Third Reliability Determination Method]

As describe above, the magnitude of a change of density with respect to an area factor varies depending on inks with which an alignment pattern is printed, a printing method, a printing medium, and the like. For example, when an optical characteristic of an alignment pattern printed with a light-color ink is measured by an optical sensor, a difference between densities of respective alignment patterns becomes smaller compared with one in the case of other inks. Furthermore, a density detected and the degree of an influence of a disturbance on the density vary depending on optical characteristics of an LED and a photodiode to be used for measurement. Therefore, the reliability of density data is determined to be low, in the case of using a printing method or an optical measuring method of an alignment pattern, or a combination of these methods in which: a change of density showing a shifting amount in a relative position is not sufficiently large; and the density data is largely influenced by a disturbance. For example, when an ink with an optical characteristic of the color that is difficult to measure is used for the printing of the alignment pattern, the reliability of density data is determined to have a low reliability.

Moreover, the second and third reliability determination methods are combined and can be adopted as a single reliability determination method. That is, a determination as to whether density data and a density curve exhibit a correlation to a certain degree or higher is performed for each different printing method or for each optical measuring method. For example, a threshold value of a standard deviation at which an adjusting value does not greatly vary due to a disturbance is set for each ink color, and the threshold value is set low for an ink color having a low reliability.

[Combination of Reliability Determination Methods]

In this embodiment, the first, second, and third reliability determination methods of density data are combined for use as needed. Since the third reliability determination method depends on adjustment items of a registration, a calculation method may be determined in advance. The first determination method can be applied in a stage of optical characteristic is measured. The second determination method can be applied in a stage in which a density curve is determined from density data. As can be seen from the above, since the determination methods are different from each other, two or more determination methods can be combined as needed. For example, in a process procedure such as one shown in FIG. 7, use of combined determinations enables calculation of an adjusting value.

[Example of Calculation of Alignment Value]

More specifically, an aspect of an application of the reliability determination methods to density data is described. As shown graphs (C1), (D1) and (E1) in FIG. 8 as examples, density data with respect to shifting amounts of relative positions are described. For the density data, an adjusting value is obtained along a process of a reliability determination process shown in FIG. 7.

Figure 7:
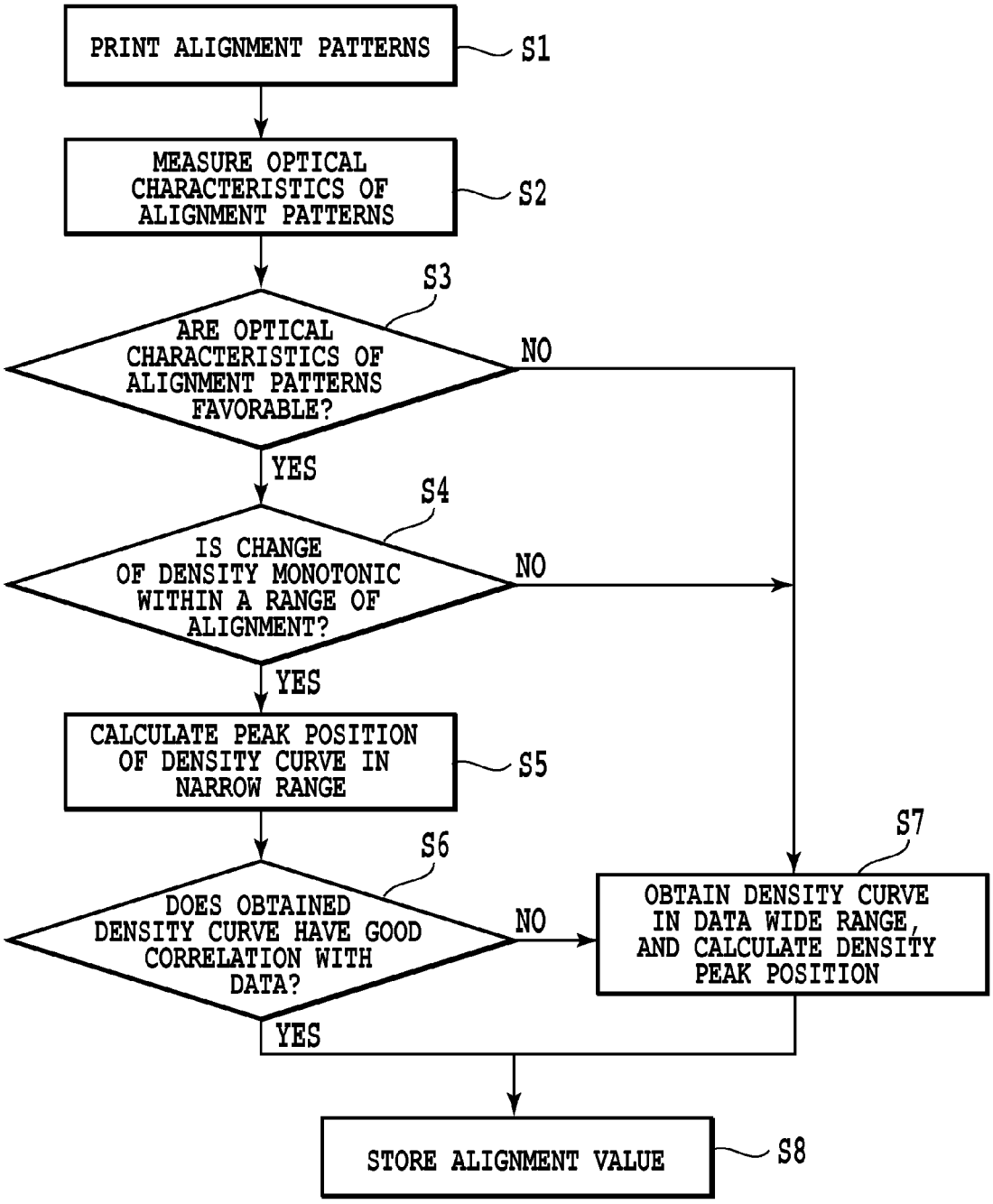
FIG. 7 is a flowchart according to the first embodiment of the invention, the flowchart showing an example of a procedure for calculating an adjusting value by combining to density data with multiple reliability determination methods.

First, seven alignment patterns whose shifting amounts of relative printing positions of second alignment pattern elements relative to first alignment pattern elements differ from each other are printed in Step S1 of FIG. 7 and, thereafter, optical characteristics of the seven alignment patterns are measured by the optical sensor 30 in Step S2. It is determined (Step S3), by the third reliability determination method, whether density data obtained by measuring the alignment patterns by use of the optical sensor is reliable, based on inks used for printing, an LED, a printing medium, and the like. It is assumed that the density data of FIG. 8 are determined to be reliable.

Subsequently, the second reliability determination method is applied to determine (Step S4) whether density data change monotonically in the shifting range of the relative printing position. The shifting amount of the relative printing position herein represents a shifting amount of printing position from a state there is no position misalignment between two alignment pattern elements. In (C1) and (E1) in FIG. 8, the density changes monotonically from its peak. However, the density of (D1) in FIG. 8 does not change monotonically, and there are data in which density is extremely deviated. Therefore, the density data of (D1) in FIG. 8 are determined to be not reliable.

The data of (C1) or (E1) in FIG. 8, whose reliability has not been determined to be low, is used for obtaining an approximate curve expressing a change of density. Density data to be used for calculating this approximate curve are only those of five alignment patterns, each data being within a certain range from a peak as shown in FIG. 8 (Step S5). Approximate curves obtained for each data of (C2) and (E2) in FIG. 8 are shown in dashed lines. Density data used are shown by black circles. An application of the first determination method makes it clear that the density data of (E2) in FIG. 8 does not have good correlation with the approximate curve corresponding thereto while the density data of (C2) in FIG. 8 has good correlation with the approximate curve corresponding thereto. Therefore, the approximate curve of (E2) in FIG. 8 has not reproduced the change of density and, therefore, the reliability of this density data is determined to be low (Step S6).

Concerning the density data of (C2) in FIG. 8 whose reliability has been determined to be high in accordance with the processes performed so far, a shifting amount of a relative position at the peak position of approximate curve of data of the five alignment patterns is calculated. This shifting amount is decided as an adjusting value, and is stored.

In the cases of the pieces of density data of (D1) and (E1) in FIG. 8 whose reliabilities have been determined to be low by the application of the above-described methods, these data pieces are processed in Step S7. Here, in order to reduce the influence of a disturbance on the change of density, a range of data used for calculating an approximate curve is increased more than the range for highly reliable data, and data of seven alignment patterns are used. An adjusting value is determined from a peak position of the approximate curve indicated by a solid line which is determined from density data of the range thus increased.

In this embodiment, when reliability is determined by the second reliability determination method, among data of seven alignment patterns, those of five alignment patterns each of which is within a certain range from a density peak are used.

That is, the second reliability determination method is applied to these five pieces of data, and when reliabilities are confirmed on the determinations of all these data pieces, an adjusting value is finally determined based on approximate curves of the five pieces of data. Meanwhile, when it is confirmed that an application of any one of the third, first, and second determination methods to these five data pieces does not show their reliability, a range of the density data to be used for the calculation of an approximate curve is increased, and an adjusting value is determined based on an approximate curve as to data pieces of the seven alignment patterns. That is, data pieces of five points are used when the reliability is determined to be high, while data pieces of seven points are used when the reliability is determined to be low. An approximate curve is fitted to the data pieces, thereby, a standard deviation of data from a function of the approximate curve becomes small, so that an accuracy of an adjusting value can be improved. Accordingly, when there is substantially no influence of a disturbance and when data are reliable, only the obtaining of an approximate curve for the five alignment patterns enables a quick and accurate determination of an adjusting value, so that a registration process is quickly performed. Meanwhile, when there is an influence of a disturbance, an adjusting value is determined based on an approximate curve as to data pieces of seven alignment patterns and, thereby, the influence of the disturbance is avoided as much as possible, so that an accurate adjusting value can be obtained.

In addition, in the processes of this embodiment, before determination of reliability, seven alignment patterns are printed in advance in Step S1 of FIG. 7. Here, a peak position of the density may be calculated firstly, and data pieces of five alignment patterns which are within a certain range from the density peak may be used so that they can be provided for determinations in the third, first, and second methods.

Further, in Step S1, instead of seven alignment patterns within a wide range, for example, five alignment patterns within a narrow range may also be printed so that they can be provided for the above third, first, and second reliability determinations. When it is determined that the data does not have reliability in any one of the determinations, two more alignment patterns may be added and printed to newly obtain an approximate curve so that an adjusting value can be determined. However, this embodiment is more advantageous than the above in points that variation of the densities is possibly reduced and that the throughput of a registration process can be improved, and so on, since alignment patterns are printed at one time and, therefore no additional alignment pattern is printed after a certain time period.

In addition, the foregoing descriptions are only examples: the number of alignment patterns to be printed, or the number of alignment patterns or the number of pieces of density data to be used at in the beginning of reliability determination, and further, the number of pieces of density data which is increased to obtain an approximate curve in accordance with a result of a reliability determination, and the like; and the number thereof can naturally be any suitable one.

Second Embodiment

Next, other embodiment to which the reliability determination is applied is described.

Figure 9:
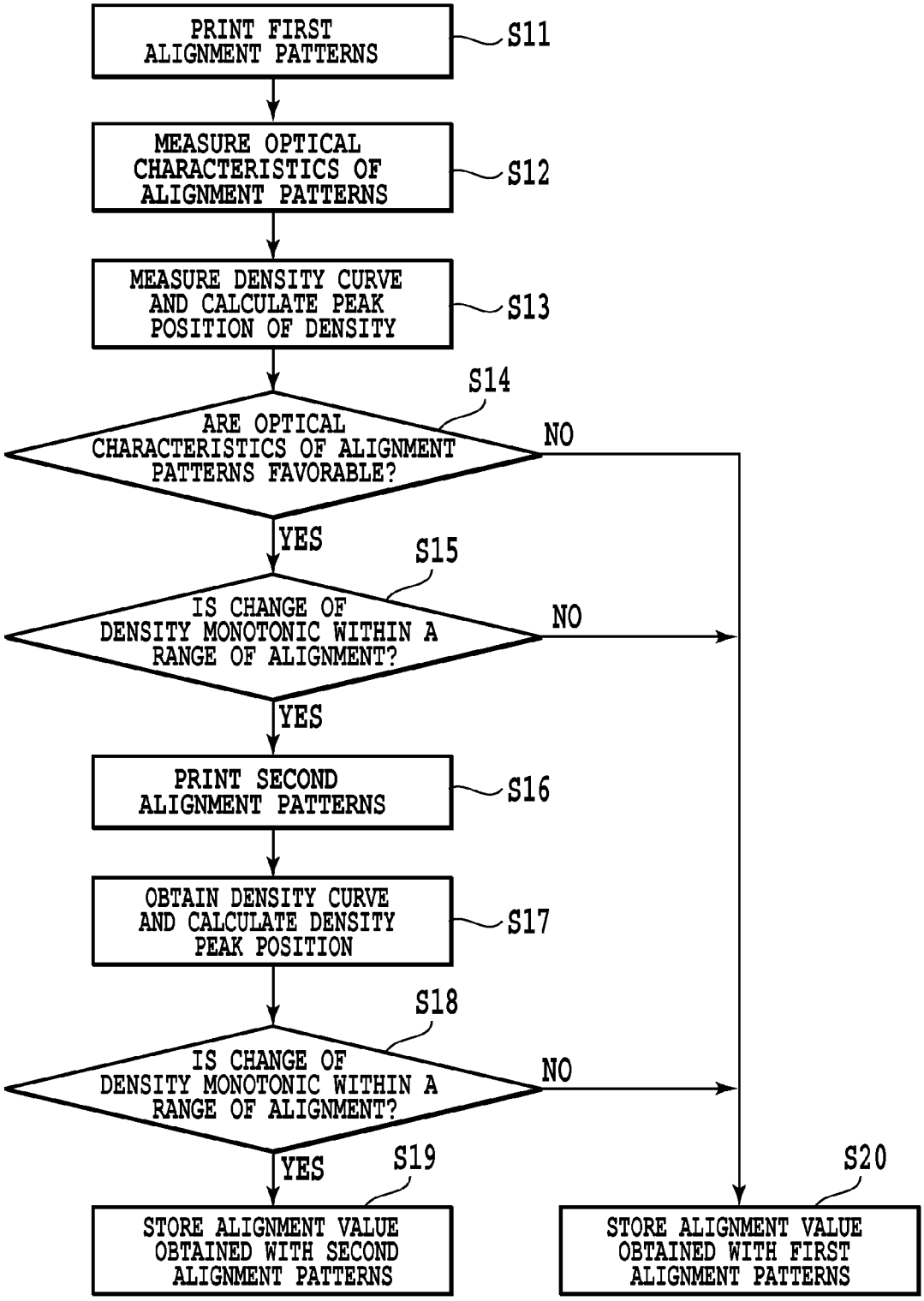
FIG. 9 is a flowchart showing a process procedure of a second embodiment of the invention.

FIG. 9 shows procedures of processes of the determining reliability and the obtaining of an adjusting value in a second embodiment of the invention. In this embodiment, two groups of alignment patterns can be printed, and a second group of alignment patterns is printed in accordance with the reliability of data of a first group of alignment patterns. The first group of alignment patterns is for a coarse alignment satisfying an alignment range required for a mechanical tolerance of a printing apparatus. Meanwhile, the second group of alignment patterns, a unit of shifting of a relative printing position between alignment pattern elements is set smaller than that for the first group of alignment patterns so as to have a high accuracy of an alignment. In the first embodiment, as a result of a reliability determination, when the obtaining of an adjusting value with high accuracy and with less influence by a disturbance can be expected, a range of density data to be used is limited and, thereby an accuracy of an adjusting value is improved. In contrast, in the second embodiment, as a result of a reliability determination, when it is determined that an influence of a disturbance on an adjusting value is small, the second group of alignment patterns having a smaller unit of shifting than the first group of alignment patterns is used to obtain an adjusting value so that an accuracy of an adjusting value is intended to be improved.

Additionally, dot dispositions may be different between the first and second groups of alignment patterns, and a range of shifting of a relative printing position between alignment pattern elements in the second group of alignment patterns may also be narrower than that of the first group of alignment patterns.

An object of use of the second group of alignment patterns is, when a characteristic of density data obtained by the optical sensor 30 is favorable, to determine an adjusting value by use of a second group of alignment patterns having a higher accuracy than the first group of alignment patterns. Further, when the reliability of density data of the first group of alignment patterns is low and when an improvement of the accuracy cannot be expected in a combination of printing methods because of an influence of a disturbance, the second group of alignment patterns is not printed in the same combination of the printing methods. Accordingly, the shortening of alignment time and the saving of printing media can be achieved.

Now, with reference to FIG. 9, a group of alignment patterns (a first group of alignment patterns) is printed (Step S11) on a printing medium as in the first embodiment, and an optical characteristic is measured (Step S12) by the optical sensor 30. Subsequently, after a density peak calculation (Step S13), the third and first reliability determinations which are the same as those described above are further performed (Steps S14 and S15). When there is no missing data in the third and first reliability determinations, the second reliability determination does not need to be performed.

When density data of the first group of alignment patterns determined to be reliable by the third and first reliability determinations, it is considered that the data is hard to be influenced in the printing methods of this combination, so that the second group of alignment patterns is, further, printed on a printing medium (Step S16). An optical characteristic of the second group of alignment patterns is also similarly measured by the optical sensor 30. In addition, density data are extracted in the same manner as described above, and an approximate curve is obtained from this density data, so that reliability of the second alignment pattern is determined by the second reliability determination method (Steps S17 and S18). Incidentally, prior to this process, the third reliability determination may be applied.

When the second alignment patterns are determined to be reliable, an adjusting value is calculated based on a peak position of an approximate curve which is obtained from density data extracted from the second alignment patterns, and then is stored in the printing apparatus (Step S19). Meanwhile, in the reliability determination having been performed so far, when the reliability of density data of the first alignment pattern is determined to be low (when a negative determination is made in Step S14 or S15), an adjusting value is calculated based on an approximate curve obtained from the extracted density data of the first alignment patterns, and then is stored in the printing apparatus. Further, also when the reliability of density data of the second alignment pattern is determined to be low (when a negative determination is made in Step S18), an adjusting value is calculated based on an approximate curve obtained from the extracted density data of the first alignment patterns, and then is stored in the printing apparatus.

Incidentally, also in this embodiment, a range of density data to be used may naturally be increased depending on a result of a reliability determination.

The configurations and the numbers of the above-described arrays of ejection openings and of print heads are simply examples, and further, the types, the numbers, and the like of the above-described ink color tones are also examples. Therefore, for all described above, any suitable ones may be adopted. For example, in the above-described examples, the single print head is configured so that total of two arrays, one for a black ink and the other for color (C, M, Y) inks, of ejection openings are provided to the print head. However, two or more arrays of ejection openings maybe provided for the same color tone, or one or more arrays of ejection openings may be provided for each color tone. Further, the number of array of ejection openings provided to a single print head, or the number of print heads may suitably be determined. In addition, the invention is effective not only for a relationship between arrays of ejection openings, but also for a registration process in a case of bi-directional printing by use of the same array of ejection openings. In that sense, the configuration of the invention may also be one including only a single array of ejection openings.

In each of the above-described embodiments, description has been given to the case where the invention is applied to an inkjet printing apparatus which forms an image on a printing medium by ejecting inks onto the printing medium from a print head. However, the invention is applicable to any type of printing apparatus so long as it forms dots to perform printing while moving a print head and a printing medium relatively to each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application No. 2007-205911, filed Aug. 7, 2008, which is hereby incorporated by reference herein in its entirety.

What is claimed is:

1. A printing position alignment method for aligning printing positions by first and second printing operations, comprising:

a printing step of printing a plurality of alignment patterns, each alignment pattern being composed of a first alignment pattern element printed by the first printing operation and a second alignment pattern element printed by the second printing operation, each alignment pattern indicating a different optical characteristic due to a misalignment in a relative printing position of the second alignment pattern element relative to the first alignment pattern element, and the plurality of alignment patterns being printed by shifting the relative printing position of the second alignment pattern element relative to the first alignment pattern element;

a measuring step of measuring the respective optical characteristics of the plurality of alignment patterns;

a determination step of determining reliability of the plurality of alignment patterns based on, among data of the plurality of optical characteristics thus measured, data indicating that a misalignment of the relative printing position of the second alignment pattern element to the first alignment pattern element is smallest and data of optical characteristics in the neighborhood of the data indicating the smallest misalignment; and an adjusting value obtaining step of, in a case where the reliability is determined to be high in the determination step, obtaining an adjusting value for aligning the printing positions based on a smaller number of pieces of data of the optical characteristics than that in the case where the reliability is determined to be low.

2. A printing position alignment method as claimed in claim 1, wherein in the adjusting value obtaining step, in a case where the reliability is determined to be high in the determination step, the adjusting value is obtained based on the data indicating the smallest misalignment and the data of the optical characteristics in the neighborhood thereof, and in a case where the reliability is determined to be low, the adjusting value is obtained based on data of the optical characteristics of a plurality of the alignment patterns in a wider shifting range of the relative printing position than that in the case where the reliability is determined to be high.

3. A printing position alignment method as claimed in claim 1, wherein the first and second printing operations are performed by at least one of an operation in which different printing elements each print for either of the first and second printing operations while moving relative to a printing medium, and an operation in which the printing of the same printing element is performed for both the first and second printing operations while reciprocating relative to the printing medium.

4. A printing position alignment method as claimed in claim 1, wherein in the determination step, the reliability is determined to be high when the optical characteristic of the alignment pattern changes monotonically relative to a shifting amount in the relative printing position.

5. A printing position alignment method as claimed in claim 1, wherein in the determination step, the reliability is determined to be low when the optical characteristic of a color used for the printing of the alignment pattern is difficult to measure.

6. A printing position alignment method as claimed in claim 1, wherein in the determination step, the reliability is determined to be high when a coefficient of correlation or a standard deviation of the data indicating the smallest misalignment and the data of the optical characteristics in the neighborhood thereof to a function is a certain value or above, the function obtained from the data indicating the smallest misalignment and the data of the optical characteristics in the neighborhood thereof as a distribution of the optical characteristic.

7. A printing position alignment method for aligning printing positions by first and second printing operations, comprising:

a printing step of printing a plurality of first alignment patterns, each first alignment pattern being composed of a first alignment pattern element printed by the first printing operation and a second alignment pattern element printed by the second printing operation, each first alignment pattern indicating a different optical characteristic due to a misalignment in a relative printing position of the second alignment pattern element relative to the first alignment pattern element, and the plurality of first alignment patterns being printed by shifting the relative printing position of the second alignment pattern element relative to the first alignment pattern element;

a measuring step of measuring the respective optical characteristics of the plurality of alignment patterns;

a determination step of determining reliability of the plurality of the first alignment patterns based on, among data of the plurality of optical characteristics thus measured, data indicating that a misalignment of the relative printing position of the second alignment pattern element to the first alignment pattern element is smallest and data of optical characteristics in the neighborhood of the data indicating the smallest misalignment; and an adjusting value obtaining step of, in a case where the reliability is determined to be low in the determination step, obtaining an adjusting value for aligning the printing positions based on data of the plurality of optical characteristics, and in a case where the reliability is determined to be high in the determination step, printing a plurality of second alignment patterns different from the first alignment patterns, measuring respective optical characteristics of the second alignment patterns thus printed, and obtaining an adjusting value for aligning the printing position on the basis of data of the plurality of optical characteristics of the second alignment patterns thus measured.

8. A printing position alignment method as claimed in claim 1, wherein a inkjet printing head that ejects ink for performing the first and second printing operations is used.

9. A printing apparatus that performs first and second printing operations and capable of aligning printing positions by the first and second printing operations, comprising:

a controller which makes the printing apparatus print a plurality of alignment patterns, each alignment pattern being composed of a first alignment pattern element printed by the first printing operation and a second alignment pattern element printed by the second printing operation, each alignment pattern indicating a different optical characteristic due to a misalignment in a relative printing position of the second alignment pattern element relative to the first alignment pattern element, and the plurality of alignment patterns being printed by shifting the relative printing position of the second alignment pattern element relative to the first alignment pattern element;

a measuring unit which measures the respective optical characteristics of the plurality of alignment patterns;

a determination unit which determines reliability of the plurality of alignment patterns based on, among data of the plurality of optical characteristics thus measured, data indicating that a misalignment of the relative printing position of the second alignment pattern element to the first alignment pattern element is smallest and data of optical characteristics in the neighborhood of the data indicating the smallest misalignment; and an adjusting value obtaining unit, in a case where the reliability is determined to be high by the determination unit, which obtains an adjusting value for aligning the printing positions based on a smaller number of pieces of data of the optical characteristics than that in the case where the reliability is determined to be low.

10. A printing apparatus that performs first and second printing operations and capable of aligning printing positions by the first and second printing operations, comprising:

a controller which makes the printing apparatus print a plurality of first alignment patterns, each first alignment pattern being composed of a first alignment pattern element printed by the first printing operation and a second alignment pattern element printed by the second printing operation, each first alignment pattern indicating a different optical characteristic due to a misalignment in a relative printing position of the second alignment pattern element relative to the first alignment pattern element, and the plurality of first alignment patterns being printed by shifting the relative printing position of the second alignment pattern element relative to the first alignment pattern element;

a measuring unit which measures the respective optical characteristics of the plurality of alignment patterns;

a determination unit which determines reliability of the plurality of the first alignment patterns based on, among data of the plurality of optical characteristics thus measured, data indicating that a misalignment of the relative printing position of the second alignment pattern element to the first alignment pattern element is smallest and data of optical characteristics in the neighborhood of the data indicating the smallest misalignment; and an adjusting value obtaining unit which, in a case where the reliability is determined to be low by the determination unit, obtains an adjusting value for aligning the printing positions based on data of the plurality of optical characteristics, and in a case where the reliability is determined to be high by the determination unit, prints a plurality of second alignment patterns different from the first alignment patterns, measures respective optical characteristics of the second alignment patterns thus printed, and obtains an adjusting value for aligning the printing position on the basis of data of the plurality of optical characteristics of the second alignment patterns thus measured.

* * * * *